US006192560B1

(12) United States Patent
Ulbrich et al.

(10) Patent No.: US 6,192,560 B1
(45) Date of Patent: Feb. 27, 2001

(54) METHOD AND DEVICE FOR TRANSFERRING A YARN SHEET FROM A YARN WINDER ONTO A WINDING BEAM

(75) Inventors: Horst Ulbrich, Niederuzwil; Guido Bommer, Wil, both of (CH)

(73) Assignee: Benninger AG, Uzwil (CH)

( * ) Notice: Subject to any disclaimer, the term of this patent is extended or adjusted under 35 U.S.C. 154(b) by 0 days.

(21) Appl. No.: 09/313,638

(22) Filed: May 18, 1999

(30) Foreign Application Priority Data

Jun. 17, 1998 (EP) ..... 98810555

(51) Int. Cl.[7] ..... D02H 13/26
(52) U.S. Cl. ..... 28/190; 28/194
(58) Field of Search ..... 28/190, 191, 192, 28/194, 195, 172.1, 172.2

(56) References Cited

U.S. PATENT DOCUMENTS

| | | | | |
|---|---|---|---|---|
| 1,835,492 | * | 12/1931 | Honeyman, Jr. | 28/195 |
| 2,026,315 | * | 12/1935 | Kahlisch | 28/195 |
| 2,033,738 | * | 3/1936 | Reiners et al. | 28/195 |
| 2,066,888 | * | 1/1937 | Kahlisch | 28/195 |
| 2,092,811 | * | 9/1937 | Moncrieff et al. | 28/190 |
| 2,127,803 | * | 8/1938 | Alderman | 28/105 |
| 4,141,120 | * | 2/1979 | Schenk | 28/191 |
| 5,775,622 | * | 7/1998 | Jurgens et al. | 28/194 |

FOREIGN PATENT DOCUMENTS

| | | | | |
|---|---|---|---|---|
| 2827536 | * | 1/1980 | (DE) | 28/195 |
| 3237887 | | 4/1984 | (DE) . | |
| 3340049 | | 5/1985 | (DE) . | |
| 0 391 129 A2 | | 3/1990 | (EP) . | |
| 391129 | | 3/1990 | (EP) . | |
| 517655 | | 5/1992 | (EP) . | |
| 0 391 129 B1 | | 8/1994 | (EP) . | |

OTHER PUBLICATIONS

Search Report Nov. 11, 1999.

* cited by examiner

*Primary Examiner*—Amy B. Vanatta
(74) *Attorney, Agent, or Firm*—Shoemaker and Mattare, LTD

(57) ABSTRACT

The yarn sheet (1) of a finished yarn winding (2) for example on a warping machine is with the help of a transfer means (8) transferred onto a winding beam (3) for example of a beaming machine. The transfer means with this has a suspension rod (9) which preferably can be displaced on a transport chain pair (10) along an advance path from the region of the yarn winding (2) to the region of the winding beam (3).

9 Claims, 4 Drawing Sheets

Figure 1:
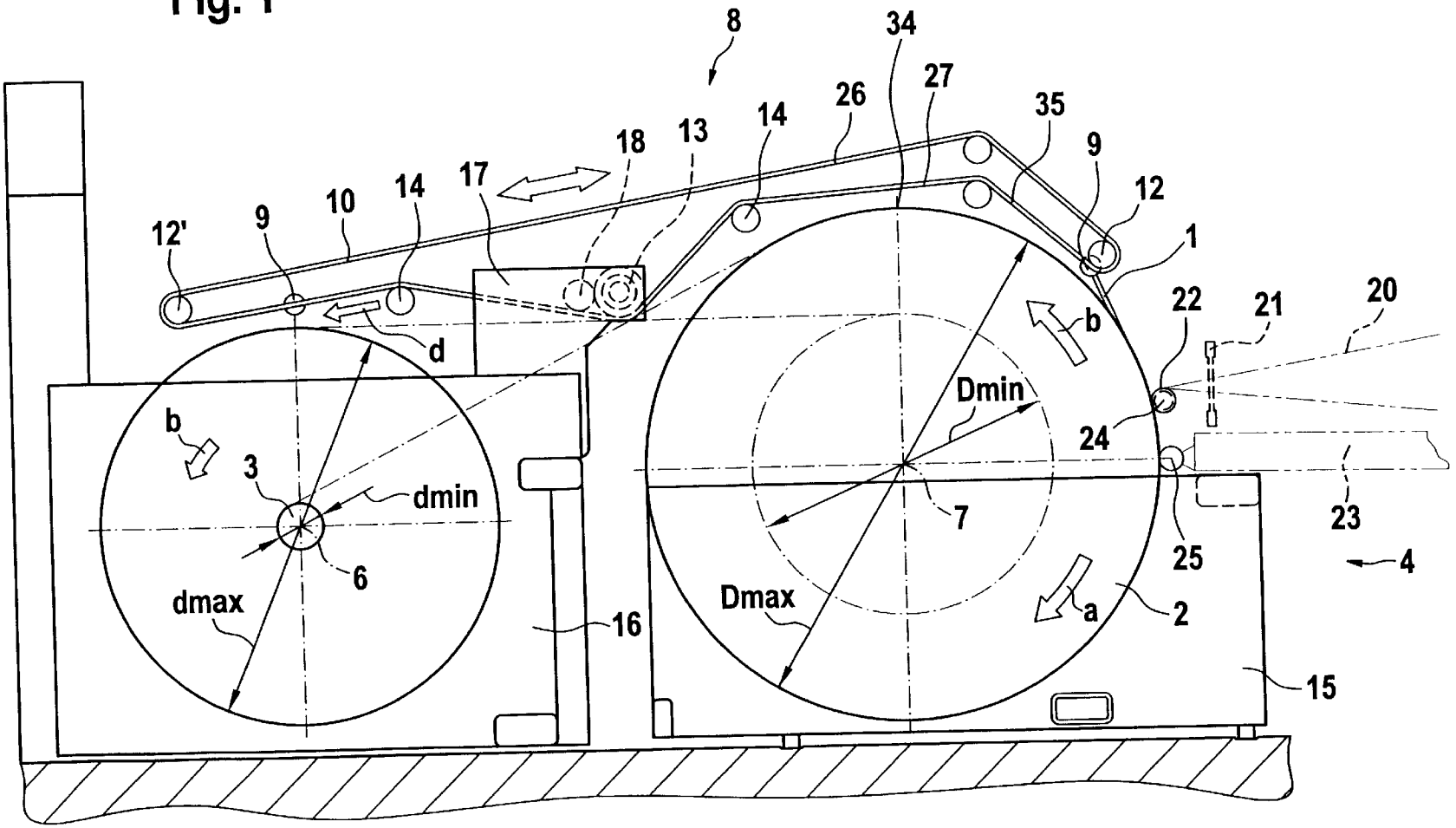

METHOD AND DEVICE FOR TRANSFERRING A YARN SHEET FROM A YARN WINDER ONTO A WINDING BEAM

The invention relates to a method for transferring a yarn sheet from a yarn winder onto a winding beam. With such methods or with such devices specifically for weaving workshops the warp beams are wound in the full width of the later warp. With the yard winding from which the yarn sheet is later removed it may be the case of a warp winding in a warping machine. Alternatively however also warp beams may be wound. Before the winding of the yarn sheet onto the beam the yarn sheet could furthermore pass through a treatment module such as e.g. a waxing device.

By way of EP-A-391 129 there is known a device for rewinding sheet warps in which above the warping sheet drum and the winding beam there is arranged a motorically drivable conveying means for a sheet warp gripping rod to be attached thereto during the laying around of the sheet warp. The conveying means consists of two endlessly revolving transport belts arranged parallel to one another and to the sheet warp yarns, wherein the belts are provided with suspension hooks thereon for the sheet warp gripping rod which is arranged to be suspended therebetween by its ends. The yarn sheet with the transfer is however wound over the bottom surface of the warping drum and reaches the warping beam via higher placed deflecting rollers. The continuous maintaining of a yarn tensioning is not possible with this since the sheet warp gripping rod for suspending in the suspension hooks must first be guided through manually below the bottom surface and then lifted. With this the yarn sheet may loosen on the transfer procedure which later leads to irregular warps.

With the known device according to the state of the art it is furthermore not possible to divert the present deflecting rollers between the warping drum and the beam. Also a treatment module for impinging the yarn sheet with a treatment fluid may not be incorporated.

It is therefore the object of the invention to provide a method and a device of the previously mentioned type in order to simplify and accelerate the transfer of the yarn sheet and in order to ensure a homogeneous quality of the yarn sheet on transfer. Furthermore the device should be applicable in a multitude of ways and selectively permit also the incorporation of deflecting rollers or treatment modules with a later beaming process. This object with respect to the method is achieved with a method as described below.

The suspension rod moved with a transfer means ensures a completely uniform removal of the yarn sheet in the transfer phase until the yarn sheet is fastened on the winding beam. Since constantly a yarn tensioning is maintained there does not exist the danger that the yarn sheet falls apart in an unordered manner. The yarn sheet is wound over the vertex line of the yarn winding which however presupposes that the yarn winding previously has been wound over the foot line according to the teaching of EP-A-517 655. On removal of the yarn sheet the suspension rod may be applied in a manner such that no loosening of the yarn sheet occurs.

The yarn winding with this is impinged by a braking force at least during the transfer of the yarn sheet. With this on displacing the suspension rod an almost constant yarn tensioning may be maintained. A braking means such as e.g. a drum brake is normally present on the winding means in any case.

The endless transport chains may be tensioned also over complicated curve paths and they require only a relatively small design cost. A parallel maintaining of the suspension rods to the rotational axes of the winding or the winding beam may be particularly easily achieved.

Design advantages may be achieved beacause the revolving direction of the transport chains is reversible and because the suspension rod may be transported to the winding beam on a lower chain face as well as on an upper chain face. In this manner with one and the same transfer device, according to the direction of movement of the transport chains two different guiding paths may be travelled. This may for example be applied in that between the two chain faces a deflecting roller or a treatment module for the yarn sheet is arranged in a manner such that the deflecting roller or the treatment module with the suspension rod may be travelled underneath on the lower chain face and travelled above on the upper chain face. If the treatment module for example consists of a sizing roller then the yarn sheet may be selectively guided over the sizing roller or bypassing the sizing roller may be stretched on the winding beam. In both cases no particular provisions are required and the yarn sheet remains tensioned, irrespective of over which guiding path it reaches the winding beam.

The transfer means is advantageously formed such that it engages over the winding device and the winding beam. The free distance between the periphery of the yarn winding and the suspension rod in the starting position on the one hand and between the winding beam and the suspension rod in the transfer position on the other hand should with this be as short as possible. Particularly advantageously with this the transport chains comprise at least one chain section which on the side of the winding machine distant to the winding beam runs between the plane of the rotational axis of the winding machine and the plane of the vertex line of the full winding. The transport chain in this manner may be led over a circumferential angle of up to 45E or more over the yarn winding from the top downwards. The suspension rod is at the same time in the starting position heavily approximated to the run-up point of the individual yarns on setting up the yarn winding. A loosening of the yarn sheet is also avoided independently of the circumferential direction of the transport chains because the yarn sheet can be wound over the vertex line of the winding. By way of this the suspension rod does not need to be guided through below the bottom surface before it may be suspended on the chains.

The synchronisation of the transport chains is effected advantageously via a gear shaft between the two outermost deflection wheels of a transport chain, preferably in a central region of the transport chains. The gear shaft then does not appear at the ends of the tension means gear is a disturbing manner as is the case with the device according to EP-A-391 129.

Figure 2:
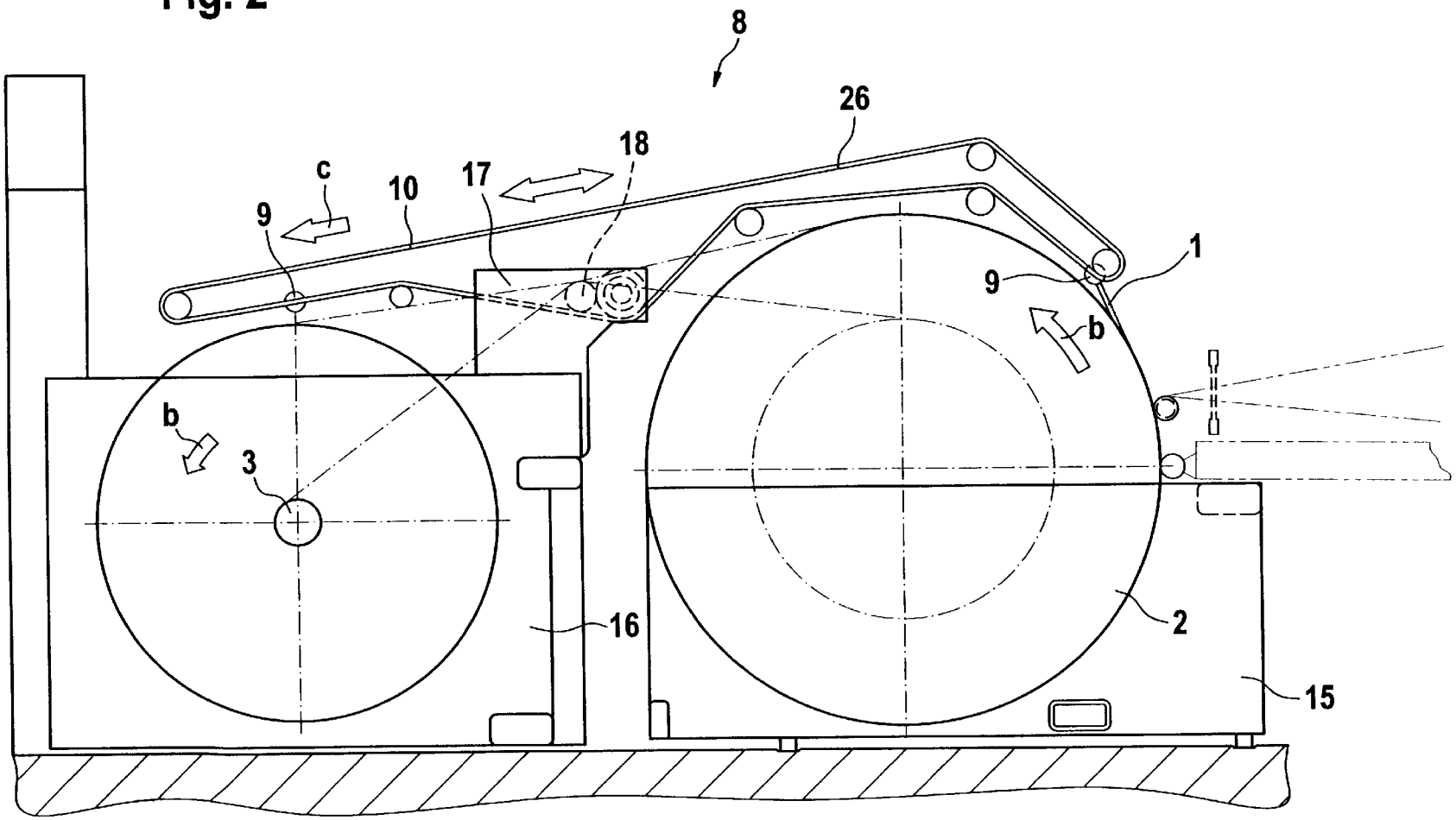
Figure 3:
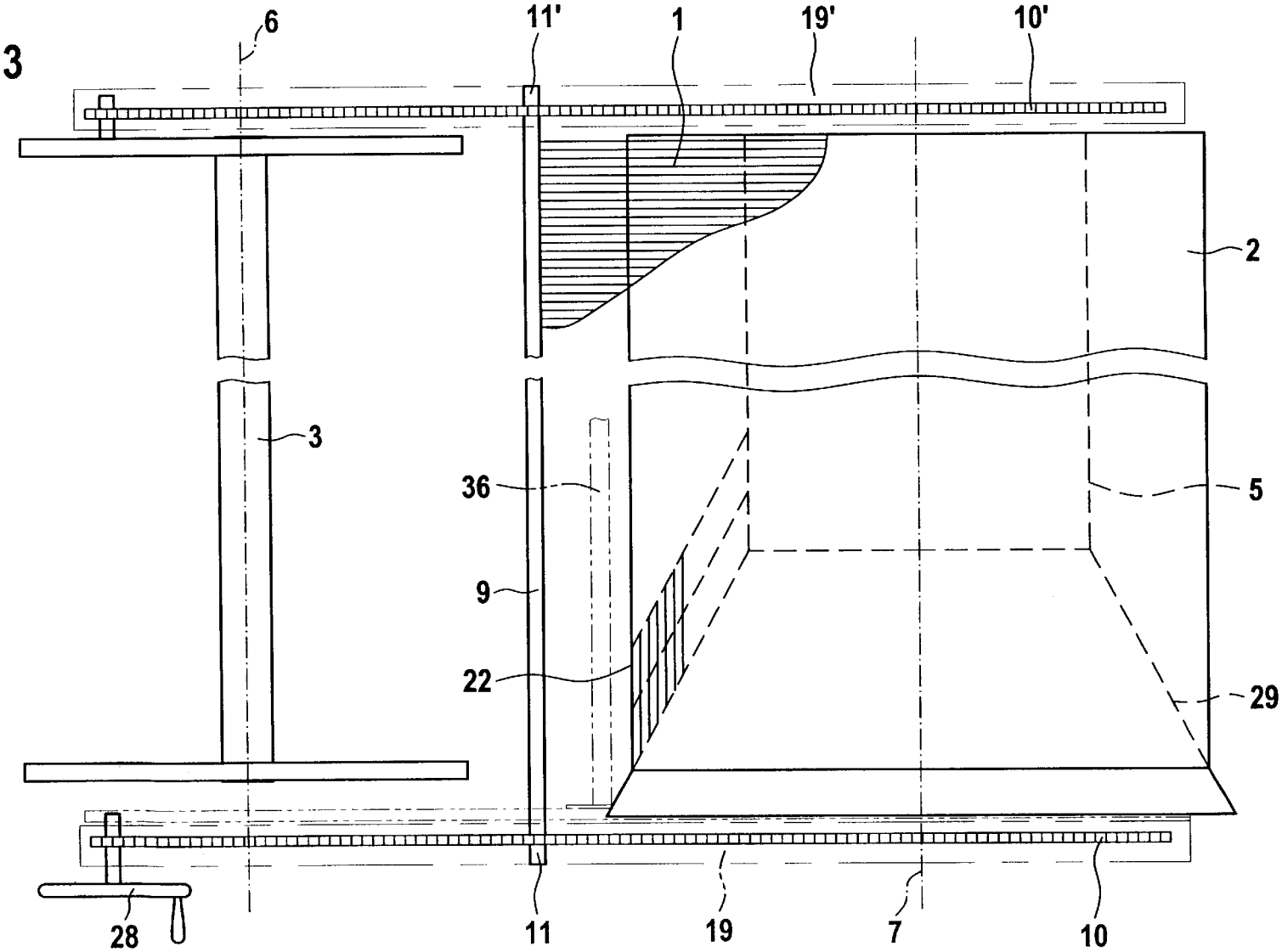
Figure 4:
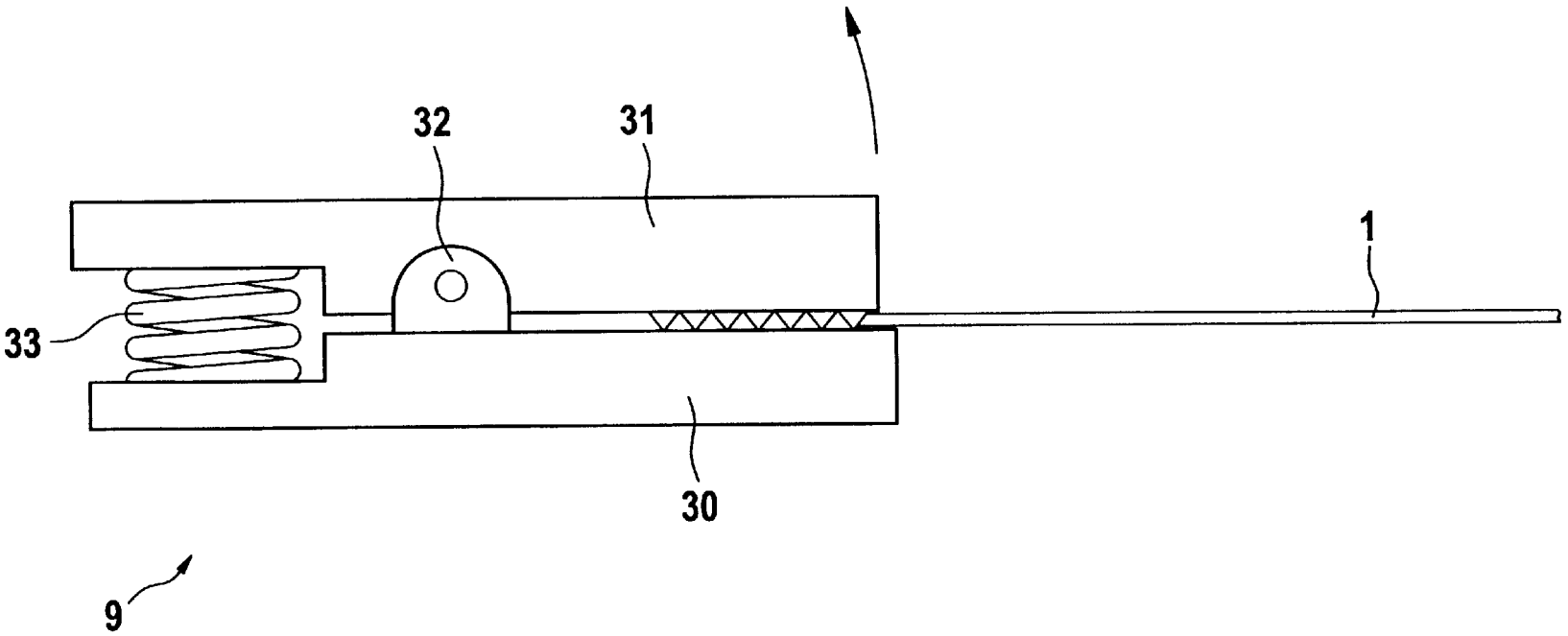

Further advantages and individual features of the invention result from the drawings and from the subsequently described embodiment example. There are shown:

FIG. 1 a heavily schematised lateral view of the device according to the invention, FIG. 2 the device according to FIG. 1 with an alternative guiding of the yarn sheet, FIG. 3 a plan view of the device according to FIG. 1, and FIG. 4 a lateral view of a suspension rod.

According to the FIGS. 1 and 3 in a winding device indicated as a whole at 4, a yarn winding, specifically a warp winding, is wound on a warping drum 5. The warping drum in the known manner on one side has a warping cone 29 on which the individual warping tapes 22 are wound in a layered manner. The warping drum for winding up and unwinding the yarns rotates about the rotational axis 7 in a frame 15.

The procedure for constructing the warp winding 2, already known from EP-A-517 655 is effected as follows: from a spool creel which is not shown here a yarn structure 20 is removed and on a warping reed 21 is led together to a warping tape 22. The warping reed is seated on a warping carriage 23 which, corresponding to the cone gradient of the warping cone and the increasing winding thickness and with respect to its distance to the shearing drum, is radially displaceable. Likewise fastened to the warping carriage 23 is a deflecting roller 24 about which the warping tape 22 is wound onto the warping drum downwards in the direction of arrow a. A press roller 25 ensures that the deposition of tape on the drum is equalised. After all warping tapes have been wound on in the required sequence, the yarn sheet 1 in the whole width in the direction of arrow b is wound off from the warping drum 5 and is wound onto a winding beam 3 arranged parallel next to this.

The winding beam 3 is mounted in a rotationally movable manner about a rotational axis 6 in a machine frame 16. The winding beam 3 as well as the warping drum 5 are in working connection with drive means, braking means and control means which are however generally known to the man skilled in the art.

Before the yarn winding 2 can be wound off evidently the beginning of the yarn sheet 1 must be guided onto the winding beam 3 and attached here. This transfer of the yarn sheet is effected with the transfer means 8 which extends over the machine frames 15 and 16. They consist essentially of two endless transport chains 10 and 10' which are guided parallel to one another and which are stentered laterally on chain carrier frames 19 and 19'. Between the two transport chains there is fastened a suspension rod 9 with its ends 11 and 11' onto the chains. With this the suspension rod runs in each chain position parallel to the two rotational axes 6 and 7. It is releasably connected to the transport chains.

With the embodiment example the transport chains at their outermost ends are tensioned around the chain defelection wheels 12 and 12'. Additional chain tensioning wheels 14 ensure that the chains are tensioned along a predetermined guiding path. The drive is effected at at least one chain drive wheel 13 which is connected to a drive motor. Alternatively or additionally the transport chains could also be actuated via a hand wheel 28. The synchronisation of the two transport chains may at the same time be carried out at a suitable location by way of gear means. For this purpose a gear shaft 36 indicated in FIG. 3 may be provided which connects the two transport chains in a geared manner. The gear rod is in a central region arranged between the two outermost chain deflection wheels 12 and 12' so that here they do not appear in a disturbing manner. The access to the warping drum or to the winding beam is thus also possible without hindrance from above.

The transport chains have in each case one upper chain face 26 and one lower chain face 27. Since the chain drive is reversible the suspension rod may be guided over the lower as well as also over the upper chain drum. At least one section 35 of the transport chains is pulled obliquely downwards from the vertex line of the complete winding 34 on the side distant to the winding beam 3.

Between the two chain faces 26 and 27 there is arranged a treatment module, for example a planing or waxing device. To this treatment module the yarn sheet 1 may be guided over a treatment roller 18, wherein a coating is effected with any treatment means. According to whether a treatment of the yarn sheet is desired the yarn sheet must evidently be guided over the treatment roller 18 or extended through under the treatment roller. Instead of the treatment roller also a simple deflecting roller may step in which serves for measuring or regulating the warp tension on beaming. Also a so-called crimping roller for releasing interconnected wrap yarns on beaming may be arranged between the belt faces 26 and 27 and selectively be impinged through the yarn sheet or bypassed.

In FIG. 1 the maximal outer diameter of the yarn winding 2 is indicated at Dmax and the minimal outer diameter at Dmin. The outer diameter of the winding beam 3 defines the minimal outer diameter dmin before the beginning of the beaming procedure, and the maximum outer diameter of the warp beam at the end of the warping procedure is indicated at dmax. The treatment roller is arranged such that the yarn sheet at the beginning as well as also at the end of the beaming process is guided past stretched below the treatment roller. For the transfer of the yarn sheet without treatment in the treatment module 17 on the right in the drawing it is suspended onto the suspension rod 9. Subsequently the transport chains are moved in the direction of arrow d so that the suspension rod 9 on the lower chain face 27 is led past below the treatment roller 18 until it has roughly gone over the winding beam 3. Subsequently the yarn sheet is released from the suspension rod 9 and fastened to the winding beam 3. With this it may be advantageous that the suspension rod 9 is fastened to the transport means in an easily detachable manner, e.g. by suspension hooks.

FIG. 2 shows a transfer procedure with which during the beaming process a treatment of the yarn sheet on the treatment roller 18 is desired. The yarn sheet is again in the same manner fastened to the suspension rod 9 in the starting position. Subsequently the transport chains are however moved in the direction of arrow c, wherein the suspension rod 9 on the upper chain face 26 is led beyond the treatment roller 18 until it again has roughly gone over the winding beam 3. The treatment module 17 in this manner is passed over by the yarn sheet and on fastening on the winding beam 3 it lays on the treatment roller 18 with a certain angle of wrap. This angle of wrap changes only slightly with the later beaming process with an increasing beam winding thickness.

FIG. 4 shows an example for the design of a suspension rod 9. This consists here of a lower clamping strip 30 and of an upper clamping strip 31. The two clamping strips are connected to one another at a joint 32 so that they form a two-armed lever. A compression spring 33 presses the clamping side of the two clamping strips against one another so that the yarn sheet 1 may be suspended in a clamped manner. Here however various alternative possibilities are conceivable. The expression suspension rod encompasses as a rule all means which are suitable for firmly holding the yarn sheet. It thus may also be the case of a row of individual tenter hooks which are connected to one another with a friction fit.

What is claimed is:

1. A method for transferring a yarn sheet from a yarn winding onto a winding beam, said method comprising steps of rotatably mounting the yarn winding and the winding beam next to one another on parallel rotational axes, suspending the yarn sheet from a suspension rod, transferring the yarn sheet by moving the suspension rod, by means of a transfer means comprising two parallel, endless transport chains, along a path parallel to the rotational axes, while simultaneously winding the yarn sheet off of the yarn winding, toward the winding beam, and winding the yarn sheet over a vertex line of the yarn winding while maintaining yarn tension.

2. A method according to claim 1, further comprising applying a braking force to the yarn winding while transferring the yarn sheet.

3. A device for transferring a yarn sheet from a yarn winding onto a winding beam, said apparatus comprising a winding device for the yarn winding, said winding beam being rotatably mounted next to the winding device, said winding device and said winding beam having parallel axes of rotation, a transfer mechanism disposed over the winding device and the winding beam, said mechanism comprising two parallel, endless transport chains and a suspension rod releasably attached to said chains for supporting the yarn sheet, said suspension rod being displaceable along a guide path from a region of the winding device into a region of the winding beam, said chains being reversibly driven, and said suspending rod being transportable alternatively by a lower chain face and an upper chain face.

4. A device according to claim 3, further comprising a deflecting roller disposed between said lower chain face and said upper chain face in such a way that the deflecting roller may be traveled under on the lower chain face, and may be traveled over on the upper chain face.

5. A device according to claim 3, further comprising a treatment module for the yarn sheet, disposed between said lower chain face and said upper chain face in such a way that said treatment module may be traveled under on the lower chain face, and may be traveled over on the upper chain face.

6. A device according to claim 3, wherein the yarn sheet can be wound off over the vertex line of the winding.

7. A device according to claim 3, wherein the transport chains comprise at least one chain section which on the side of the winding machine remote from the winding beam runs between the plane of the rotational axis of the winding machine and the plane of the vertex line of the complete winding.

8. A device according to claim 3, wherein the transport chains are synchronized by a gear shaft extending between two outermost deflection wheels of the transport chain.

9. A device according to claim 8, wherein the gear shaft is arranged intermediate the transport chains.

* * * * *